US005348457A

United States Patent [19]

Suzuki et al.

[11] Patent Number: 5,348,457

[45] Date of Patent: Sep. 20, 1994

[54] VANE-TYPE COMPRESSOR WITH AT LEAST ONE SUCTION HOLE

[75] Inventors: Hiroyuki Suzuki; Shinichi Hara; Mitsuya Ono, all of, Saitama, Japan

[73] Assignee: Zexel Corporation, Tokyo, Japan

[21] Appl. No.: 108,888

[22] Filed: Aug. 18, 1993

[30] Foreign Application Priority Data

Sep. 1, 1992 [JP] Japan ..... 4-257356

[51] Int. Cl.[5] ..... F01C 1/00

[52] U.S. Cl. ..... 418/259; 418/15

[58] Field of Search ..... 418/259, 260, 261, 262, 418/263, 264, 265, 266, 267, 268, 269, 15

[56] References Cited

U.S. PATENT DOCUMENTS

| | | | |
|---|---|---|---|
| 4,514,157 | 4/1985 | Nakamura et al. | 418/259 |
| 4,566,869 | 1/1986 | Pandeya et al. | 418/259 |
| 4,636,148 | 1/1987 | Takao et al. | 418/259 |
| 4,898,524 | 2/1990 | Butzen | 418/259 |

FOREIGN PATENT DOCUMENTS 59-190985 12/1984 Japan .

*Primary Examiner*—Richard A. Bertsch
*Assistant Examiner*—Charles G. Freay
*Attorney, Agent, or Firm*—Frishauf, Holtz, Goodman & Woodward

[57] ABSTRACT

In a suction port for a vane-type compressor in which suction holes 15*a* and 15 *a* along the inner peripheral edge 1*a* of the cylinder 1 are disposed in the read side block 4 and notch portions 15*b* and 15*b* opposing to the suction holes 15*a* are disposed at the opening edge on he suction side of cylinder 1, the suction holes 15*a* and 15*a* are arranged outside the vane sliding zone of the rotor-side end face 4*a* of the rear side block 4. If a vane juts out of a vane groove, the tip of vane does not enter the suction holes 15*a* and 15*a* even if the tip of a vane is inclined, so that the vane does not heavily rub the end portion of the suction hole on the rotor-side end face 4*a*.

4 Claims, 10 Drawing Sheets

VANE-TYPE COMPRESSOR WITH AT LEAST ONE SUCTION HOLE

BACKGROUND OF THE INVENTION

1. Field of the Invention

The present invention relates to a vane-type compressor and, more particularly, to vane-type compressor which prevents the separation of a plating layer near the end of a suction hole on the end face on the rotor side of side block.

2. Description of the Prior Art

A vane-type compressor of prior art comprises a cylinder, two side blocks fixed to each end face of the cylinder, a rotor tolerably incorporated in the cylinder, and a vane slidably inserted in each of a plurality of vane grooves formed in the substantially radial direction of the rotor, in which one of the two side blocks is provided with a suction hole, and a notch portion opposing to the suction hole is disposed at the opening edge of cylinder block, so that a refrigerant gas is sent from a suction chamber to a compression chamber in the cylinder through the suction hole and the notch portion, which compose a suction port (Published Unexamined Japanese Utility Model No. 190985/1984).

When the rotor rotates, the vanes jut out of the vane grooves, so that the rotation is effected with the tip of the vane being in contact with the inner peripheral surface of cylinder and the side of vane being in contact with the end face on the rotor side of side block.

In this vane-type compressor, the transverse width of the vane is a little smaller than the width of cylinder to prevent the difficulty in jutting of the vane due to the difference in thermal expansion between the vane and the cylinder. Also, most of the suction hole 115*a* is located within the vane sliding zone (hatched portion in FIG. 10) of the end face on the rotor side of side block, and some of the suction hole 115*a* is located outside the vane sliding zone as shown in FIG. 10. Therefore, there has been a problem in that if the vane juts out while being inclined when starting, the tip of the vane enters the suction hole 115*a*, and heavily rubs the portion 121 near the end of the suction hole of the end face on the rotor side of side block, by which the plating layer on the end face on the rotor side separated. If the separation of plating layer due to the tip of vane proceeds, there are possibilities of damage caused by wear particles entering the sliding portion and improper compression.

SUMMARY OF THE INVENTION

An object of the present invention is to provide a vane-type compressor which prevents the separation of plating layer on the rotor-side end face of side block caused by the side of vane.

According to the present invention, the tip of vane does not enter the suction hole during the rotation of rotor, and the portion near the end of the suction port of the rotor-side end face of side block is not rubbed heavily, so that the plating layer is not separated, by which the damage due to wear particles and improper compression are prevented.

The suction port for vane-type compressor in accordance with the present invention is characterized by the following improvements:

In a suction port for a vane-type compressor comprising a cylinder, two side blocks fixed to both end faces of the cylinder, a rotor rotatably incorporated in the cylinder, a plurality of vanes slidably inserted in a plurality of vane grooves formed substantially in the radial direction of the rotor, a suction hole along the inner peripheral edge of the cylinder disposed on at least one of the side blocks, and a notch portion opposing to the suction hole disposed at the opening edge of the cylinder, the suction hole is arranged outside the vane sliding zone on the rotor-side end face of said one of side blocks.

Preferably, in a suction port for a vane-type compressor comprising a cylinder, two side blocks fixed to both end faces of the cylinder, a rotor rotatably incorporated in the cylinder, a plurality of vanes slidably inserted in a plurality of vane grooves formed substantially in the radial direction of the rotor, and a suction hole along the inner peripheral edge of the cylinder disposed on at least one of the side blocks, the suction hole is arranged within the vane sliding zone on the rotor-side end face of said one of side blocks, and a vane tip guide portion is disposed so that the suction hole is apart from the outer peripheral edge of the vane sliding zone on the rotor-side end face thereof toward the center by a predetermined distance.

Preferably, a notch portion is disposed at the opening edge of the cylinder, and an auxiliary suction hole is disposed outside the vane sliding zone on the rotor-side end face of said one of side blocks.

DETAILED DESCRIPTION OF THE PREFERRED EMBODIMENTS

The embodiments of the present invention will be described below with reference to the drawings.

Figure 2:
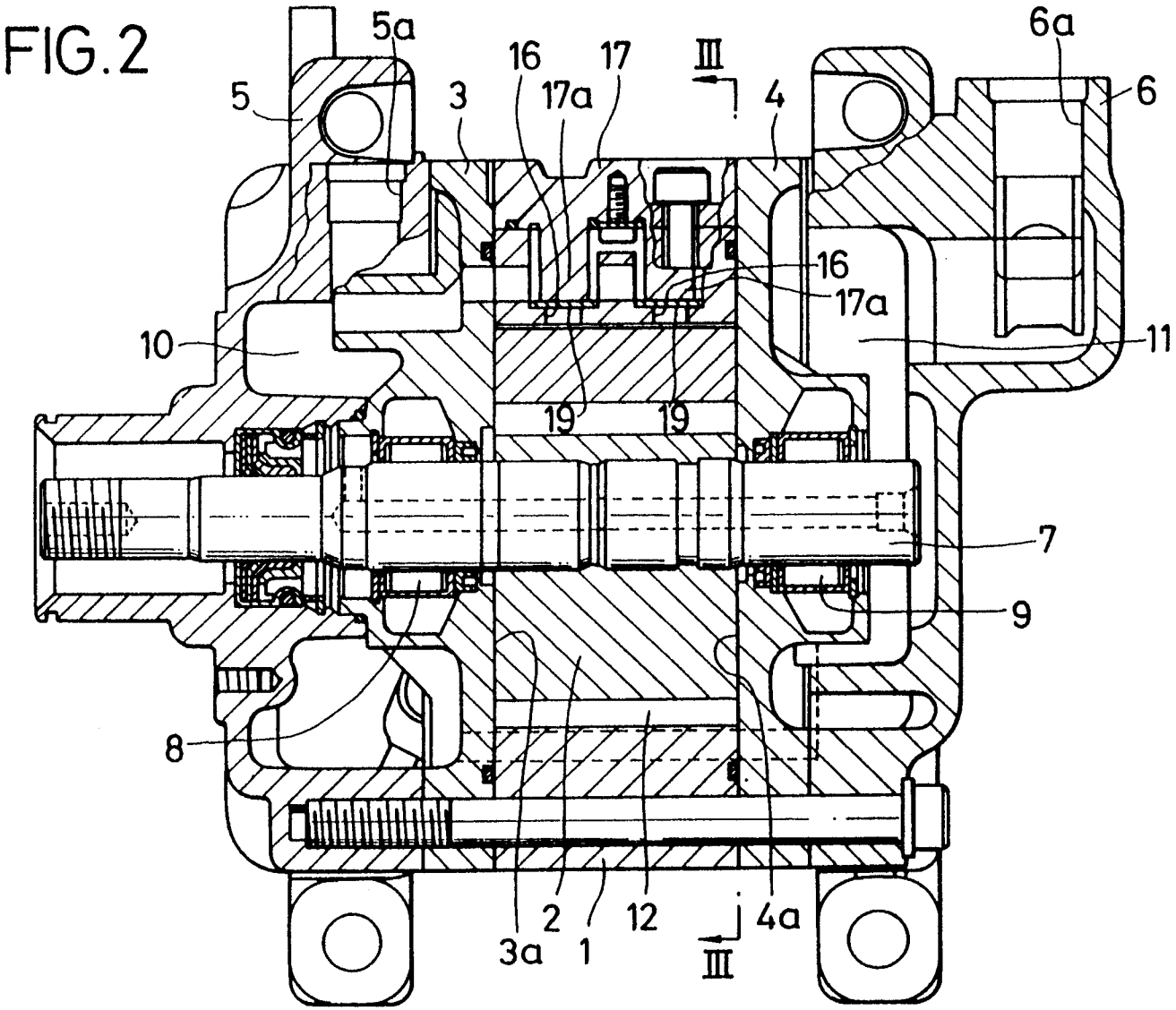
FIG. 2 is a sectional view of a vane-type compressor in accordance with one embodiment of the present invention.

FIG. 2 is a sectional view of a vane-type compressor in accordance with one embodiment of the present invention. This vane-type compressor includes a cylinder 1, a front side block 3 and a rear side block 4 which are fixed so as to close each end Face of cylinder 1, a rotor rotatably incorporated in the cylinder 1, a front head 5 and a rear head 6 fixed to the end face of side blocks 3 and 4, respectively, and a rotating shaft 7. The rotating shaft 7 is rotatably supported by bearings 8 and 9 mounted on the side blocks 3 and 4.

The front head 5 has a discharge port 5*a* of refrigerant gas, while the rear head 6 has a suction port 6*a* thereof. The discharge port 5*a* is connected to a discharge chamber 10 defined by the front head 5 and the front side block 3, while the suction port 6*a* is connected to a suction chamber 11 defined by the rear head 6 and the rear side block 4.

Figure 3:
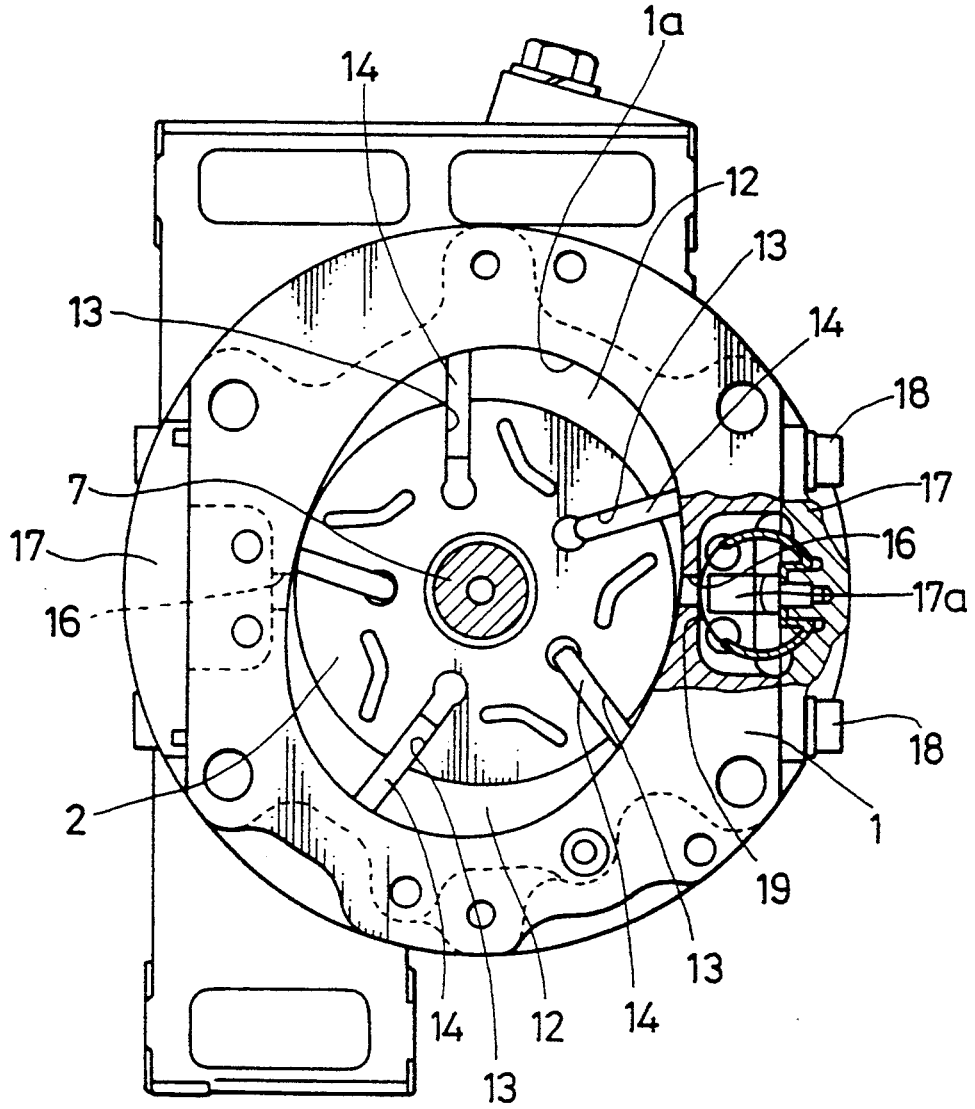
FIG. 3 is a sectional view taken alone the line III—III of FIG. 2.

Between the inner peripheral surface of the cylinder 1 and the outer peripheral surface of the rotor 2, two compression chambers 12 are formed (in FIG. 2, only one compression chamber is seen). As shown in FIG. 3, the rotor 2 is provided with a plurality of vane grooves 13, and a vane 14 is slidably inserted in each of the vane grooves 13.

Figure 1:
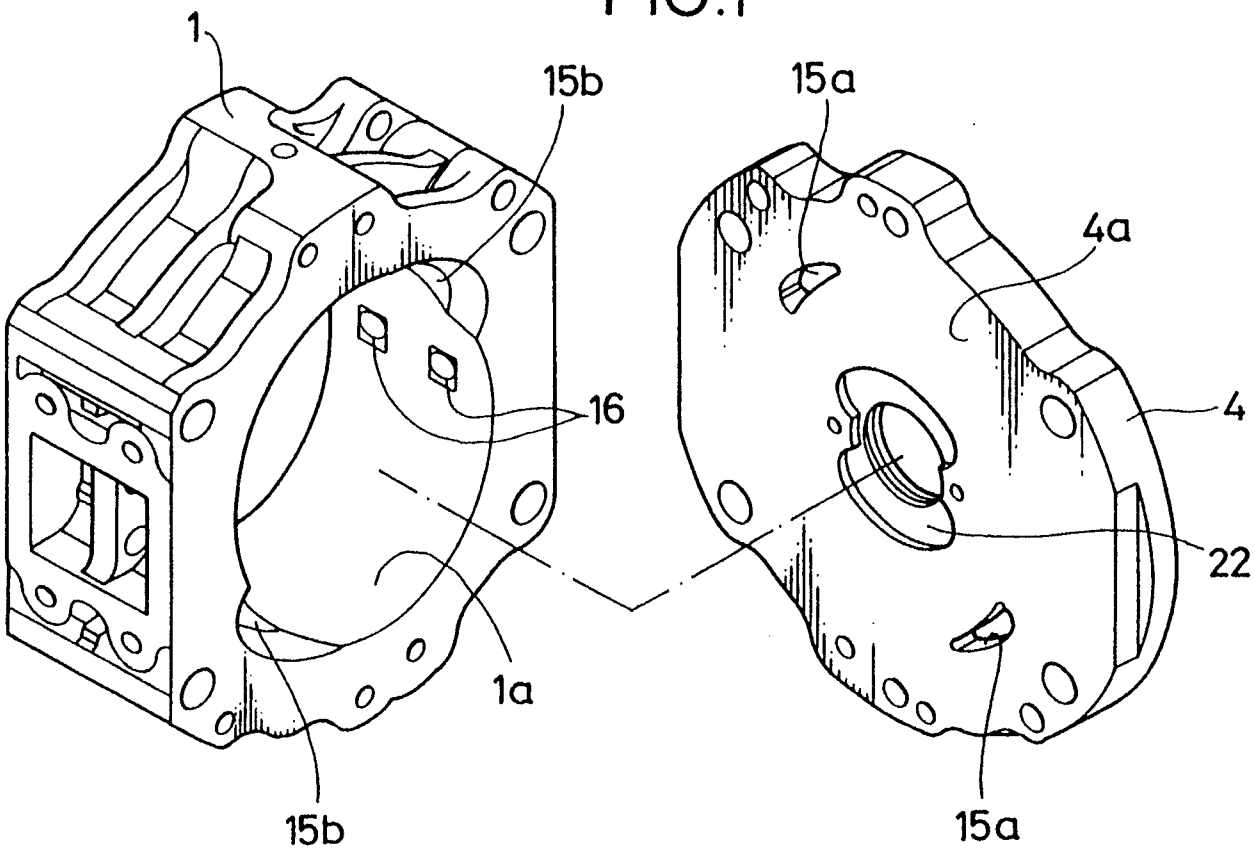
FIG. 1 is an exploded perspective view of a cylinder and a rear side block, of a vane-type compressor in accordance with one embodiment of the present invention.
Figure 4:
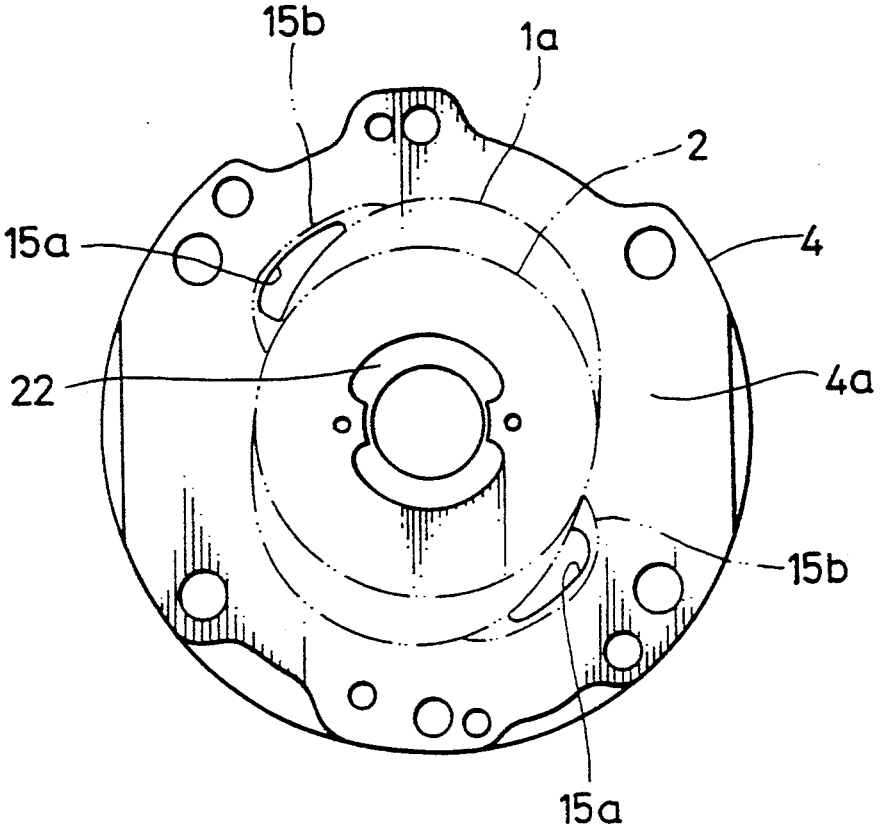
FIG. 4 is a front view of the rotor-side end face of a rear side block.
Figure 5:
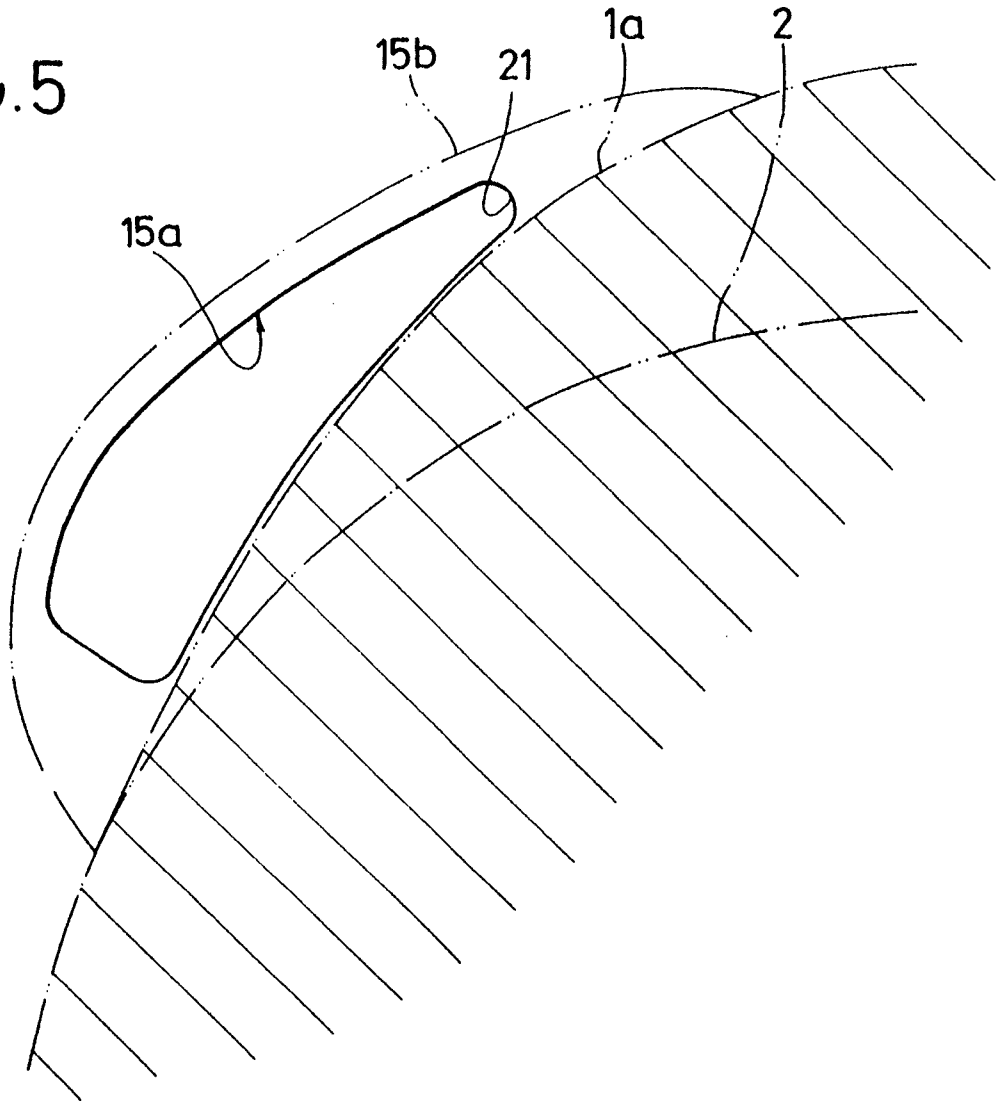
FIG. 5 is a partially expanded view of FIG. 4.
Figure 6:
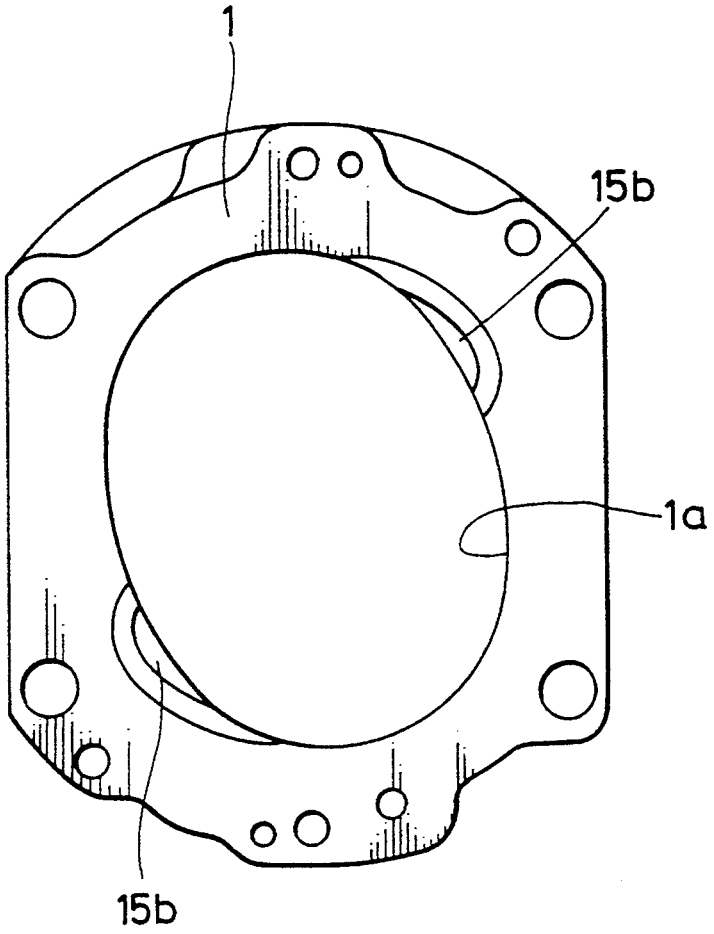
FIG. 6 is a front view of the rear-side end face of a cylinder.
Figure 7:
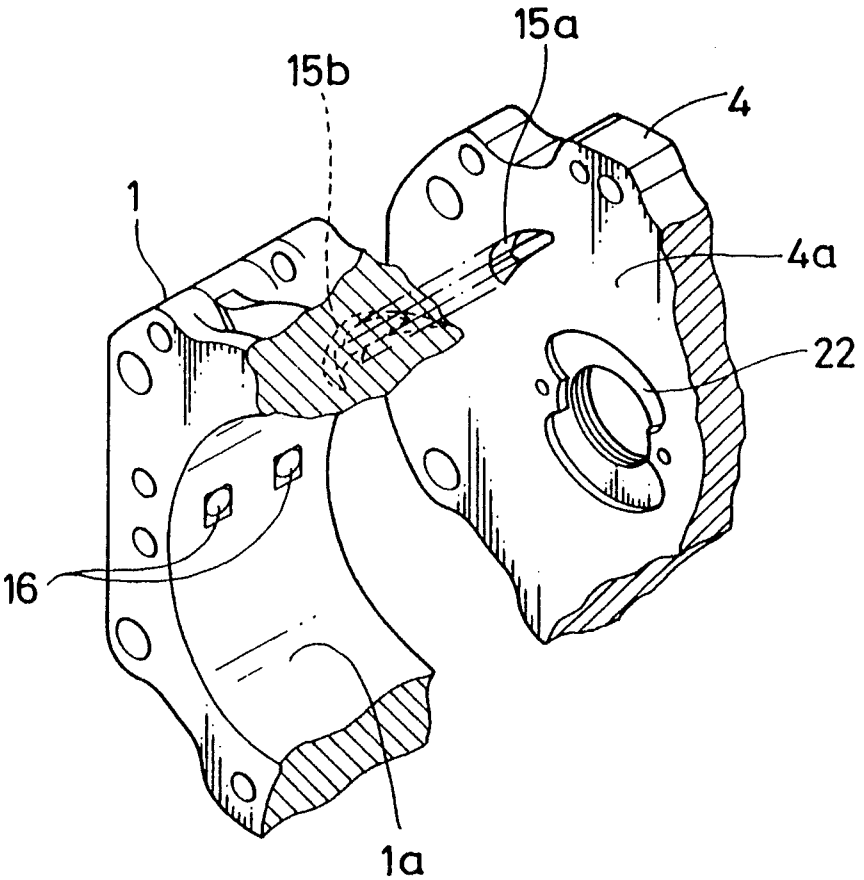
FIG. 7 is cutaway view of a cylinder and a rear side block.

The rear side block 4 has two suction holes 15*a* and 15*a* as shown in FIG. 4. The suction holes 15*a* and 15*a* are located outside the vane sliding zone (the zone where the side of the vane 14 slides) on the end face 4*a* facing the rotor 2, which is indicated by hatching in FIG. 5. Also, a back pressure groove 22 is formed on the end face 4*a* of the rear side block 4. The cylinder 1 has formed at the opening edge of a rear end thereof, notch portions 15*b* and 15*b* as shown in FIGS. 1, 6, and 7. The notch portions 15*b*, 15*b* are respectively in communication with the suction holes 15*a*, 15*a*, as is clearly shown in the drawings. The suction hole 15*a* and the notch portion 15*b* constitute a suction port, and refrigerant gas is sucked from the suction chamber 11 into the compressor 12 through the suction hole 15*a* and the notch portion 15*b*. Both the cylinder 1 and the rear side block 4 are manufactured by casting.

Two discharge ports 16 corresponding to two compression chambers 12 are disposed in the outer peripheral wall of the cylinder 1 (only one discharge port 16 is seen in FIG. 2). To the outer peripheral wall of the cylinder 1, a discharge valve cover 17 having a valve stop portion 17*a* is fixed by means of bolts 18. A discharge valve 19 held on the side of discharge cover 17 is interposed between the outer peripheral wall of the cylinder 1 and the valve stop portion 17*a*.

Next, the operation of this vane-type compressor will be described.

When a rotational power of engine (not shown) is transmitted to the drive shaft 7, the rotor 2 rotates. The refrigerant gas, which flows from the outlet of an evaporator (not shown), enters the suction chamber 11 through the suction port 6*a*, and is sucked from the suction chamber 11 to the compression chamber 12 through the suction hole 15*a* and the notch portion 15*b*. The compression chamber 12 is divided into a plurality of spaces by vanes 14. The volume of each space changes as the rotor 2 rotates, so that the refrigerant gas captured between the vanes 14 is compressed. The compressed gas opens the discharge valve 19 to flow to the discharge chamber 10 through the discharge port 16, and is then discharged through the discharge port 5*a*.

When the rotor 2 rotates, the vane 14 juts out of the vane groove 13, so that the tip of the vane 14 moves while being in contact with the inner peripheral surface 1*a* of the cylinder 1, and the sides of the vane 14 move while being in contact with the rotor-side end faces 3*a* and 4*a* of the front side block 3 and the rear side block 4.

Since the suction hole 15*a* is arranged outside the vane sliding zone as described above, even if the vane 14 juts out while being inclined, for example, when starting, the tip of the vane 14 does not enter the suction hole 15*a*, so that it does not heavily rub the vane sliding zone near the end 21 of the suction hole. As a result, the separation of plating layer on the rotor-side end face 4*a* of the rear side block 4 can be prevented, thereby the damage to the sliding portion due to wear particles and improper compression being prevented.

Figure 8:
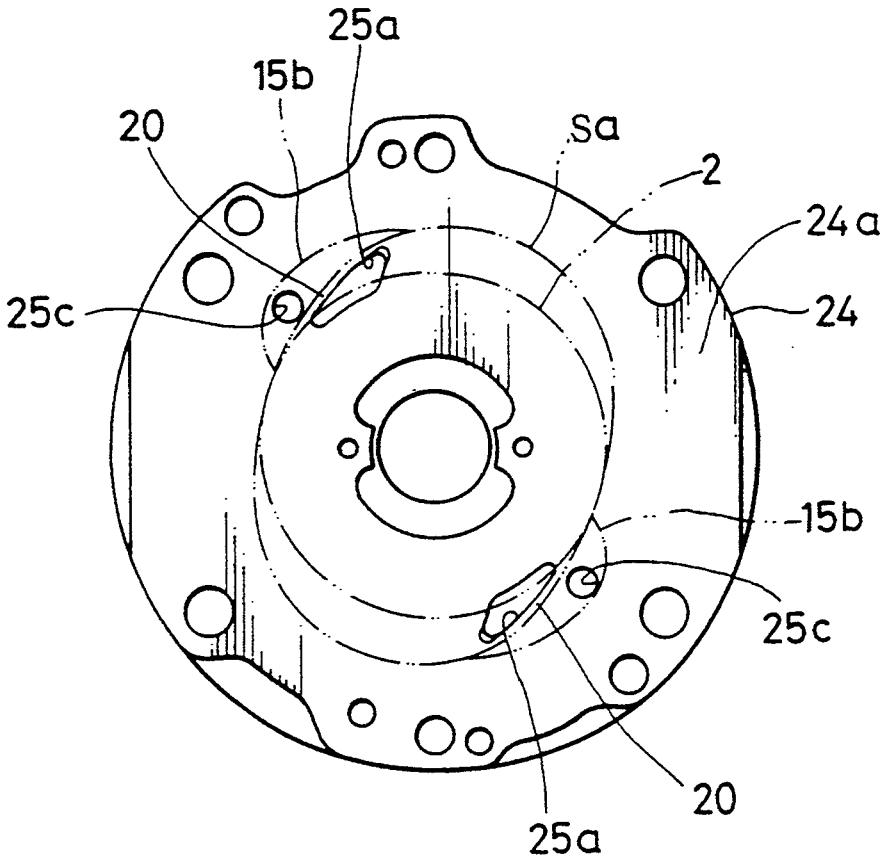
FIG. 8 is a front view of a rear side block of a vane-type compressor in accordance with another embodiment.

FIG. 8 is a front view of the rotor-side end face of a rear side block of vane-type compressor in accordance with another embodiment of the present invention. The like reference characters are applied to the parts common to those of the above-described embodiment, and its explanation is omitted.

Figure 9:
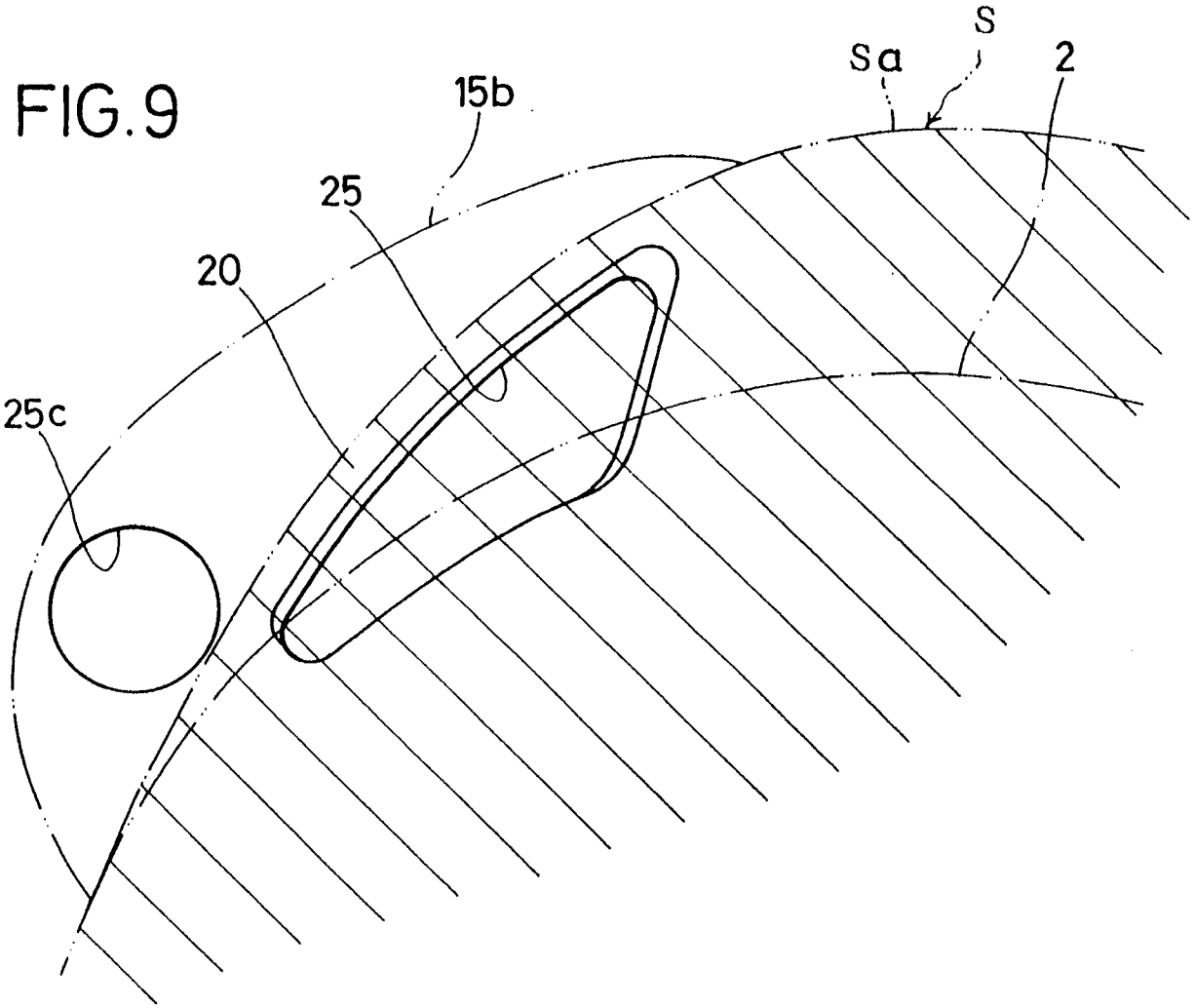
FIG. 9 is a partially expanded view of FIG. 8.
Figure 10:
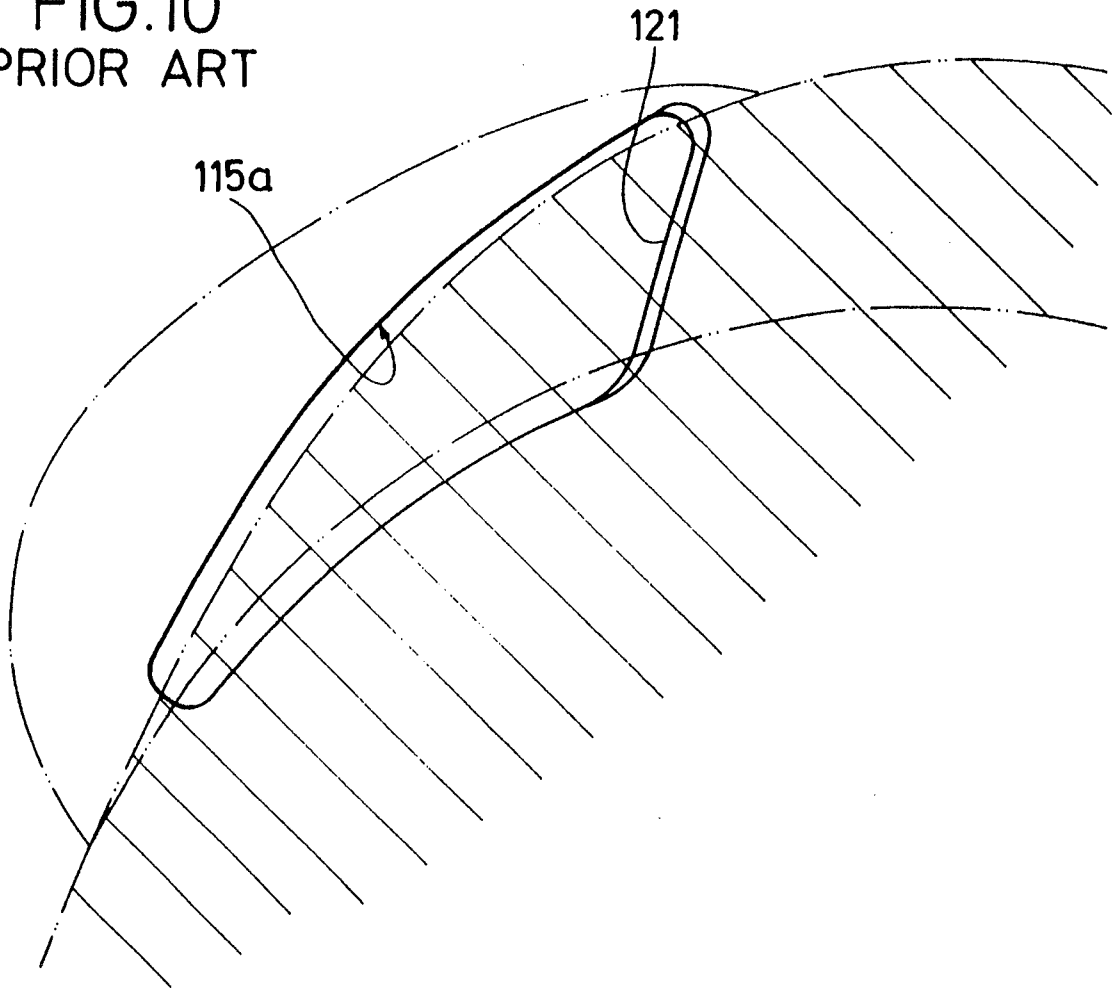
FIG. 10 PRIOR ART
FIG. 10 is a partially expanded view of a rear side block for illustrating a conventional vane-type compressor.

In the above-described embodiment, the suction hole 15*a* is arranged outside the vane sliding zone of the end face 4*a* of the rear side block 4 facing the rotor 2. Instead, in the second embodiment, the suction holes 25*a*, 25*a*, are arranged within the vane sliding zone S on the end face 24*a* of a rear side block 24 facing said rotor 2 (hatched portion in FIG. 9), and the outer peripheral edge of each suction hole 25*a* is spaced from the outer peripheral edge Sa of the vane sliding zone S (FIG. 9) toward the center by a predetermined distance (for example, 1 mm), so that a vane tip guide portion 20 is formed between the outer peripheral edge of the suction hole 25*a* and the outer peripheral edge Sa of the vane sliding zone S. Further, auxiliary suction holes 25*c*, 25*c* respectively communicated with the notch portions 15*b*, 15*b* of the cylinder 1 are disposed near the suction holes 25*a*, 25*a* of the rear side block 24 outside the vane sliding zones.

In this embodiment, the refrigerant gas in the suction chamber 11 is not only directly sucked into the compression chamber 12 through the suction hole 25*a*, but also sucked into the compression chamber 12 through the auxiliary suction hole 25*c* and the notch portion 15*b* of the cylinder 1. File decrease in suction efficiency, which is caused by the fact that the suction hole 25*a* is arranged within the outer peripheral edge 1*a* of the vane sliding zone, is prevented by the installation of the auxiliary suction hole 25*c*.

Since the tip portion of the side of the vane 14 jutting out of the vane groove 13 slides while being supported by the vane tip guide portion 20, the tip of the vane 14 does not enter the suction hole 25*a* even if the vane 14 is inclined, so that the vane 14 does not heavily rub the vane sliding zone, by which the same effect as that of the above-described embodiment can be achieved.

We claim:

1. A vane-type compressor comprising:

a cylinder having opposite ends, and at least one notch portion formed at an opening edge of one end thereof;

a rotor rotatably received within said cylinder and having a plurality of vane grooves formed substantially in the radial direction thereof;

a pair of side blocks arranged to close respective opposite ends of said cylinder, each of said side blocks having an end face facing said rotor;

a plurality of vanes slidably fitted in said vane grooves of said rotor, said vanes each having side faces which are slidable in a vane sliding zone on each of said end faces of said side blocks, and said vanes cooperating with said cylinder and said rotor to define at least one compression chamber;

a head fixed to one of said side blocks to define a suction chamber therebetween; and at least one suction hole formed through one of said side blocks, said at least one suction hole being always in communication with said at least one notch portion and said suction chamber, so that a refrigerant in said suction chamber is sucked into said compression chamber through said at least one suction hole and said at least one notch portion; and wherein said at least one suction hole is located outside of said vane sliding zone on said end face of said one of said side blocks.

2. A vane-type compressor comprising:

a cylinder having opposite ends, and at least one notch portion formed at an opening edge of one end thereof;

a rotor rotatably received within said cylinder and having a plurality of vane grooves formed substantially in the radial direction thereof;

a pair of side blocks arranged to close respective opposite ends of said cylinder, each of said side blocks having an end face facing said rotor;

a plurality of vane slidably fitted in said vanes grooves of said rotor, said vanes each having side faces which are slidable in a vane sliding zone on each of said end faces of said side blocks, and said vanes cooperating with said cylinder and said rotor to define at least one compression chamber;

a head fixed to one of said side blocks to define a suction chamber therebetween; and at least one suction hole formed through one of said side blocks, said at least one suction hole being always in communication with said at least one notch portion and said suction chamber, so that a refrigerant in said suction chamber is sucked into said compression chamber through said at least one suction hole and said at least one notch portion;

wherein said at least one suction hole is located within said vane sliding zone on said end face of one of said side blocks; and said at least one suction hole having an outer peripheral edge which is spaced from an outer peripheral edge of said vane sliding zone toward the center of said cylinder by a predetermined distance to form a vane tip guide portion between the outer peripheral edge of said at least one suction hole and the outer peripheral edge of said vane sliding zone.

3. A vane-type compressor according to claim 2, further comprising an auxiliary suction hole arranged outside of said vane sliding zone, said auxiliary suction hole being in communication with said at least one notch portion.

4. A suction port for a vane-type compressor comprising:

a cylinder having opposite end faces;

two side blocks, each side block being fixed to a respective end face of said cylinder;

a rotor rotatably mounted in said cylinder;

a plurality of vanes slidably inserted in a plurality of vane grooves formed substantially in the radial direction of said rotor; and a suction hole extending along an inner peripheral edge portion of said cylinder, said suction hole being disposed on at least one of said side blocks;

said suction hole being arranged within a vane sliding zone on a rotor-side end face of said one of side blocks;

said suction hole having an outer peripheral edge which is spaced from an outer peripheral edge of said vane sliding zone on the rotor-side end face thereof toward the center of said cylinder by a predetermined distance, to thereby form a vane tip guide portion between the outer peripheral edge of said suction hole and the outer peripheral edge of said vane sliding zone;

a notch portion formed at an opening edge portion of said cylinder; and an auxiliary suction hole arranged outside of said vane sliding zone on the rotor-side end face of said one of said side blocks.

* * * * *